US006135662A

United States Patent [19]

Bakke et al.

[11] Patent Number: 6,135,662

[45] Date of Patent: Oct. 24, 2000

[54] LESSON PLANNER

[76] Inventors: David L. Bakke, 3614 W. Villa Maria Dr., Glendale, Ariz. 85308; Donald L. Bakke, 16220 N. 62$^{nd}$ La., Glendale, Ariz. 85306

[21] Appl. No.: 09/298,518

[22] Filed: Apr. 23, 1999

[51] Int. Cl.$^{7}$ ..... B42F 13/00

[52] U.S. Cl. ..... 402/73; 281/38; 283/3; 283/36; 396/517; 396/528; 402/79; 402/80 R

[58] Field of Search ..... 281/38; 283/3, 283/36, 37, 38, 39, 40, 41, 42; 402/73, 79, 80 R; 396/517, 528

[56] References Cited

U.S. PATENT DOCUMENTS

| | | | |
|---|---|---|---|
| 1,010,895 | 12/1911 | Graff . | |
| 3,780,460 | 12/1973 | Hurt, Jr. | 40/78 |
| 3,797,152 | 3/1974 | Brandt | 402/79 |
| 4,419,837 | 12/1983 | Meeker | 40/359 |
| 4,516,871 | 5/1985 | Leitman | 402/79 |
| 4,614,450 | 9/1986 | Neiman | 402/79 |
| 4,824,273 | 4/1989 | Silva et al. | 402/79 |
| 4,974,983 | 12/1990 | Givati | 402/80 |
| 5,020,931 | 6/1991 | Sloot | 283/36 |
| 5,066,046 | 11/1991 | Hoopingarner | 281/38 |
| 5,135,401 | 8/1992 | Feldman-Schorrig | 434/395 |
| 5,375,883 | 12/1994 | Wyant | 281/37 |
| 5,377,733 | 1/1995 | Halley et al. | 150/147 |
| 5,405,169 | 4/1995 | Schwartz | 281/16 |
| 5,501,540 | 3/1996 | Ho | 402/73 |
| 5,709,496 | 1/1998 | Werner et al. | 281/38 |
| 5,722,694 | 3/1998 | Baldursson | 402/79 |
| 5,765,875 | 6/1998 | Rowley | 283/74 |
| 5,823,573 | 10/1998 | Chang | 281/38 |
| 5,957,502 | 9/1999 | Manico et al. | 402/79 |
| 6,004,061 | 12/1999 | Manico et al. | 402/79 |

*Primary Examiner*—A. L. Wellington
*Assistant Examiner*—Monica Carter
*Attorney, Agent, or Firm*—Cahill, Sutton & Thomas, PLC

[57] ABSTRACT

A lesson planner includes a foldable notebook containing a series of transparent lesson plan retaining sheets for supporting lesson planning cards used by an instructor to prepare and present a lesson plan for a class. Each lesson plan retaining sheet includes a first panel removably secured to the binder of the notebook and a second panel hingedly coupled to the first panel. The hinged coupling allows the second panel to be folded against the first panel when not in use, and to be extended outwardly away from the first panel when in use. A releasable fastener temporarily maintains the second panel proximate the first panel when the lesson plan retaining sheet is not in use. The first and second panels of each lesson plan retaining sheet including pockets for temporarily storing and displaying one of the lesson planning cards. Labels adjacent such pockets indicate the time of day each lesson is to be taught; likewise, each lesson plan retaining sheet includes a label indicating the day of the week. Lesson planning cards that are not currently inserted within the lesson planner notebook are kept in a storage box for future use.

15 Claims, 2 Drawing Sheets

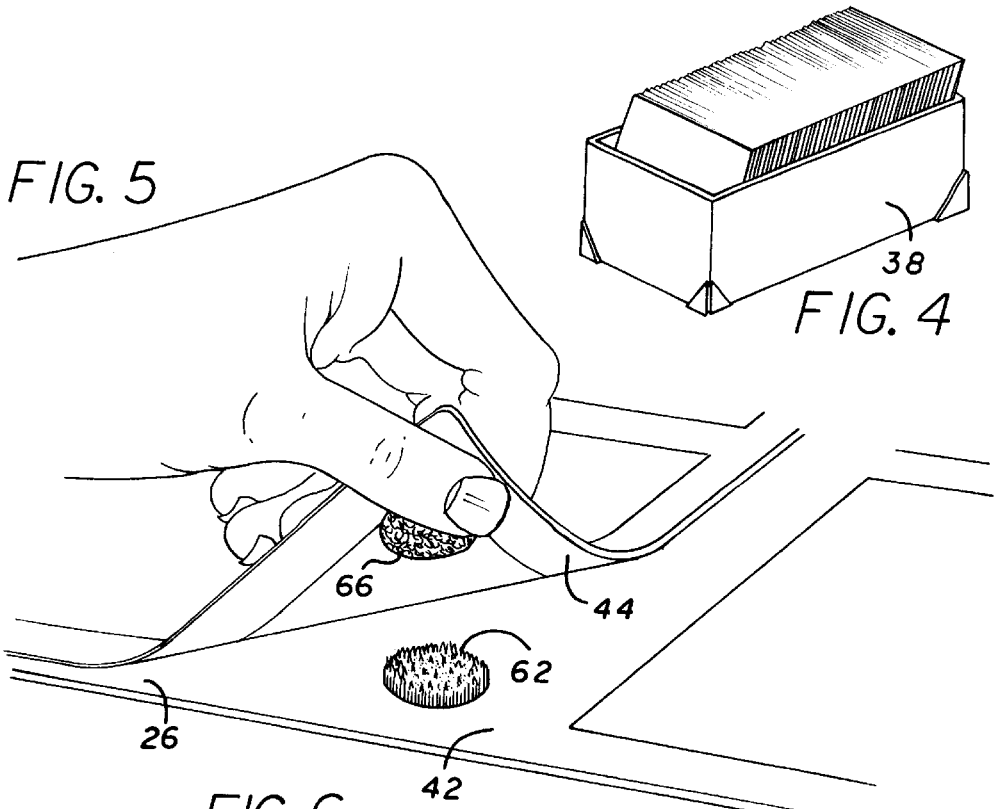
FIG. 4
FIG. 5
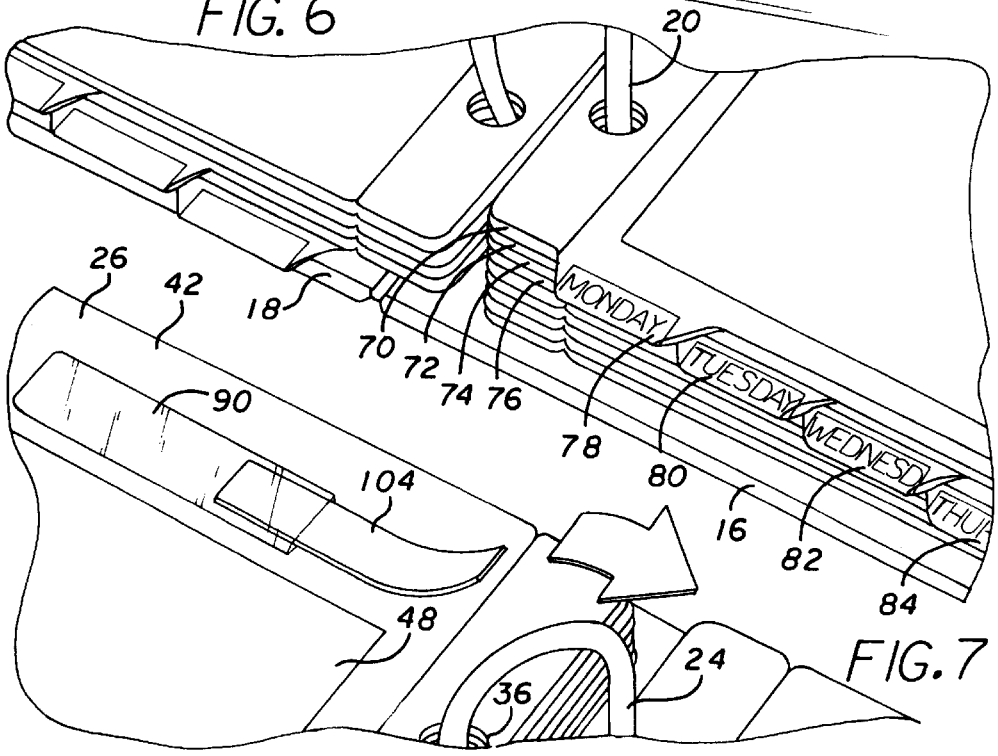
FIG. 6
FIG. 7

LESSON PLANNER

BACKGROUND OF THE INVENTION

1. Field of the Invention

The present invention relates generally to apparatus and methods used by teachers and instructors for planning and presenting lesson plans, and more particularly, to a lesson planning notebook that facilitates the preparation and presentation of lesson plans.

2. Description of the Relevant Art

In order to effectively and efficiently present new material to a class of students, an instructor must prepare a lesson plan outlining the concepts and examples to be presented. Certain lesson planning tools have long been available for teachers and other instructors. For example, lesson planning notebooks are known wherein a teacher writes the lesson onto the pages of the notebook. However, such known lesson planning notebooks often lack adequate space for inserting a detailed lesson plan, compelling the instructor to use small print that can be difficult to read in a classroom setting. Also, such lesson planning notebooks often include pages that are not easily removed from the notebook; accordingly, the instructor must write out the lesson by hand, rather than typing the lesson. In addition, the instructor must label each page of such notebook with the time of day, day of the week, class period, etc., in order to indicate the time during which such lesson should be taught. This labeling task can become a burden to the instructor. Moreover, anticipated lesson plan schedules often need to be altered due to school scheduling changes and/or the need to devote extra time to handle student questions. Therefore, the original labeling of the lesson plans may need to be revised to meet unexpected circumstances.

The present inventor has found that a standard-sized 8 and one-half inch by 11 inch sheet is insufficient to adequately display lesson planning information for an entire day of instruction. While a larger sheet could, in theory, be used, such larger sheet would not ordinarily fit within a conventional three-ring presentation binder, and a larger binder would be difficult to store and transport. On the other hand, there are advantages to maintaining all lesson plans for a single day's instruction on a single sheet of a notebook.

Accordingly, it is an object of the present invention to provide a lesson planning apparatus which can easily display typed lesson plans in order to avoid the need for the teacher to handwrite each lesson plan.

It is another object of the present invention to provide such a lesson planning apparatus which provides sufficient space to conveniently present an entire day's worth of lesson plans, while maintaining the same dimensions as a conventional three-ring binder.

Still another object of the present invention is to provide such a lesson planning apparatus which avoids the need for the teacher to write in labels on each page of the lesson plan in order to indicate the time at which each component of the lesson is to be taught.

Yet another object of the present invention is to provide such a lesson planning apparatus which allows an instructor to easily adapt to schedule changes or instances where a lesson was not completed due to student questions or unanticipated delays.

A further object of the present invention is to provide a method for more effectively planning and presenting lessons to be taught to a class using such an apparatus.

These and other objects of the present invention will become more apparent to those skilled in the art as the description of the present invention proceeds.

SUMMARY OF THE INVENTION

Briefly described, and in accordance with a preferred embodiment thereof, the present invention relates to a lesson planner which includes a foldable notebook having front and rear covers joined by a central portion equipped with rings or other releasable binding fasteners. The lesson planner also includes lesson plan retaining sheets each having an innermost edge received by the binding fasteners of the foldable notebook. The lesson planner also includes lesson plan cards of a uniform size and adapted to contain information used to assist an instructor in preparing and presenting a lesson plan for a class.

Each of the lesson plan retaining sheets has a first panel which includes the aforementioned innermost edge secured to the central portion of the notebook. Each lesson plan retaining sheet also includes a second panel hingedly coupled to the first panel along a hinged coupling opposite the aforementioned innermost edge; this hinged coupling allows the second panel to be folded proximate to the first panel when the lesson plan retaining sheet is not in use, and also allows the second panel to be extended outwardly away from the first panel, and to effectively become an extension of the first panel, when the lesson plan retaining sheet is in use. The first and second panels of each lesson plan retaining sheet each include a series of pockets; each pocket is commensurate in size with the above-mentioned lesson plan cards, and is adapted to temporarily store and display one of the lesson plan cards.

It is preferred that the first and second panels, including the pockets formed therein, which together form a lesson plan retaining sheet, be formed of a clear plastic for allowing the entire surfaces of the lesson plan cards stored therein to be visible to the user. Ideally, each lesson plan retaining sheet further includes a releasable fastener, e.g., mating Velcro-brand style hook-and-loop releasable fasteners mounted on the first and second panels, for temporarily retaining the second panel proximate the first panel when the lesson plan retaining sheet is to be maintained in its folded position.

The foldable notebook may be a conventional three-ring binder wherein the front and rear covers are hingedly connected to a central panel, and wherein the aforementioned releasable binding fasteners are spring-biased split rings or similar fasteners which can be selectively opened to permit a lesson plan retaining sheet to be added to or removed from the notebook, and selectively closed to retain inserted lesson plan retaining sheets therein. In addition, the above-described lesson planner is preferably used in conjunction with a storage box for storing lesson plan cards that are not currently inserted within a pocket of one of the lesson plan retaining sheets. For convenience, the lesson plan cards are preferably color-coded corresponding to the subject being taught, and cards of the same color can then be kept together in the same portion of the storage box.

As mentioned above, it is often helpful for an instructor to indicate within a lesson planning notebook which day, and what time of day, each portion of each lesson should be taught. In this regard, each of the lesson plan retaining sheets preferably includes a plurality of label holders. The label holders may be positioned near an outer edge of the lesson plan retaining sheet to bear a label indicating the day on which the stored lesson plans are to be taught. Likewise, a label holder is preferably located near each one of the lesson plan card storage pockets for displaying a label corresponding to a time of day during which a lesson contained on the corresponding lesson plan card is to be taught to a class.

The present invention also relates to a method of planning lessons to be taught to a class, wherein the method includes the steps of providing a notebook binder, and providing a group of lesson plan cards of uniform size each describing a portion of a lesson to be taught to the class. The improved method of the present invention preferably includes the step of providing a card storage box, and retaining lesson plan cards with such card storage box until such cards are needed for insertion within the above-mentioned lesson plan notebook. The method further includes the step of binding lesson plan retaining sheets within the notebook binder, and providing each lesson plan retaining sheet with a series of storage pockets, of a size commensurate with that of the lesson plan cards, for removably storing one of the aforementioned lesson plan cards. A subset of the group of lesson plan cards is then selected corresponding to a particular lesson to be taught to a class on a given day, and the selected subset of lesson plan cards is then inserted into the storage pockets of a lesson plan retaining sheet to display the selected lesson plan to the user.

The improved method may facilitate the planning of lessons to be taught to a class during successive class meetings. In this event, the improved method can include the additional steps of selecting from the group of lesson plan cards two or more subsets of lesson plan cards corresponding to two or more different lessons to be taught to a class on successive class meetings. The instructor may then inserting the two or more selected subsets of lesson plan cards into the storage pockets of two or more corresponding lesson plan retaining sheets to display the lesson plans for such successive class meetings.

In some instances, an instructor may be teaching two or more different courses in a single day. In this event, the improved method may include the steps of selecting, from the group of lesson plan cards, two or more subsets of lesson plan cards corresponding to two or more different lessons to be taught to different classes on a given day. The instructor may then insert the two or more selected subsets of lesson plan cards into the storage pockets of two or more corresponding lesson plan retaining sheets to display the selected lesson plans for the different classes to be taught that day.

The improved method of the present invention preferably includes the step of providing each of the lesson plan retaining sheets with first and second panels, securing the first panel to the notebook binder, and hingedly coupling the second panel to the first panel. Each of the first and second panels is provided with the aforementioned storage pockets for receiving lesson plan cards. In practicing the improved method, the step of inserting the selected subset of lesson plan cards into the storage pockets of the lesson plan retaining sheet may include the step of inserting at least one lesson plan card into a storage pocket of the first panel of a lesson plan retaining sheet, and inserting at least one lesson plan card into a storage pocket of the second panel of such lesson plan retaining sheet. The method would then include the steps of folding the second panel of the lesson plan retaining sheet along the hinged coupling proximate to the first panel thereof when such lesson plan retaining sheet is not in use, and extending the second panel of such lesson plan retaining sheet away from the first panel thereof when the lesson plan retaining sheet is in use, thereby allowing the second panel to effectively serve as an extension of the first panel. Preferably, the improved method includes the step of releasably fastening the second panel of the lesson plan retaining sheet to the first panel thereof when the lesson plan retaining sheet is not in use.

The improved method also preferably includes the steps of applying a label adjacent each storage pocket indicating a time of day during which the lesson plan card inserted within such storage pocket is to be taught. The instructor then selects from the group of lesson plan cards a subset of lesson plan cards which collectively set forth a lesson to be taught to a class on a given day, each of such selected lesson plan cards containing a particular component of such lesson. Finally, the instructor then inserts the selected subset of lesson plan cards into the storage pockets of a corresponding lesson plan retaining sheet in accordance with the time of day during which each component of the lesson is to be taught in order to display each of the inserted lesson plan cards adjacent to the label indicating the time of day during which the particular component of such lesson is to be taught.

BRIEF DESCRIPTION OF THE DRAWINGS

FIG. 4 is a perspective view of a lesson plan card storage box used to store lesson plan cards until they are needed for insertion into the lesson plan notebook.

FIG. 5 is a partial perspective view illustrating a pair of mating hook-and-loop releasable fasteners which may be used to maintain a second panel of the lesson plan retaining sheet folded against a first panel of the lesson plan retaining sheet until the instructor is ready to teach the corresponding lesson plan.

FIG. 6 is a partial perspective view of the lower edges of several lesson plan retaining sheets and showing labeling applied thereto.

FIG. 7 is a partial perspective view of the upper edge of a lesson plan retaining sheet and showing a label being inserted into a label holder disposed adjacent a storage pocket.

DETAILED DESCRIPTION OF THE PREFERRED EMBODIMENTS

Figure 1:
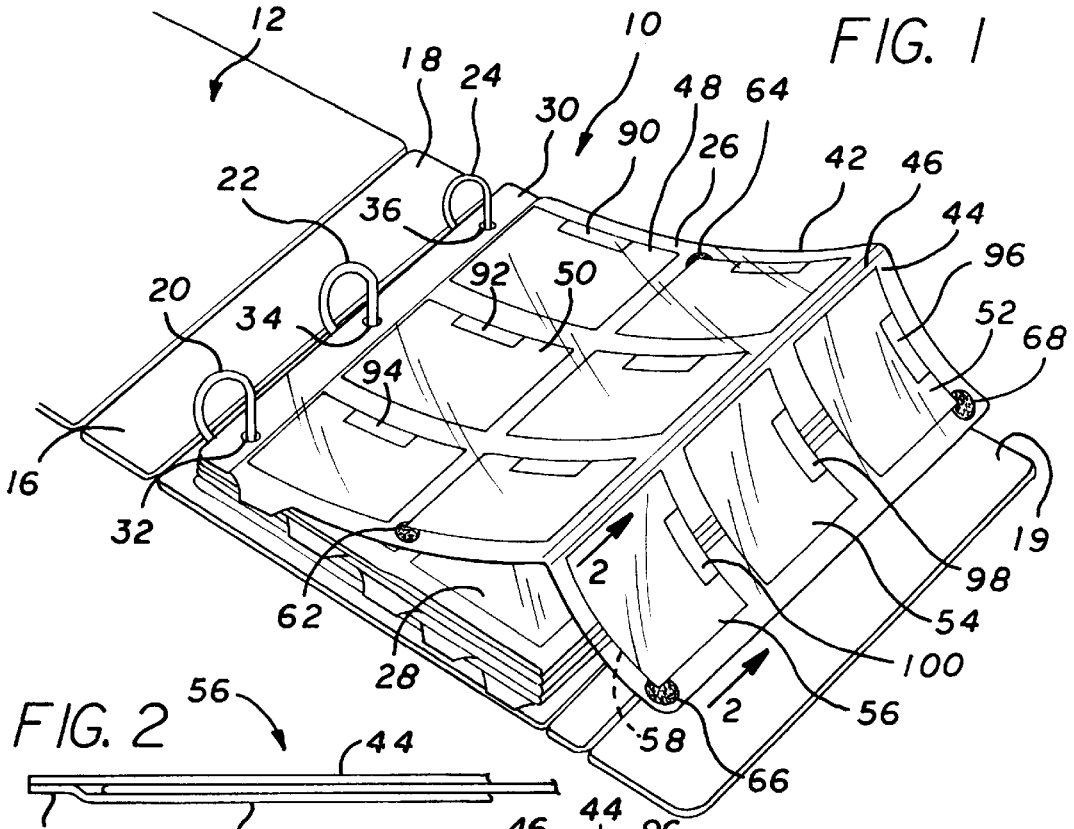
FIG. 1 is a perspective view of a lesson plan notebook constructed in accordance with the teachings of the present invention and showing a lesson plan retaining sheet in its extended position.
Figure 3:
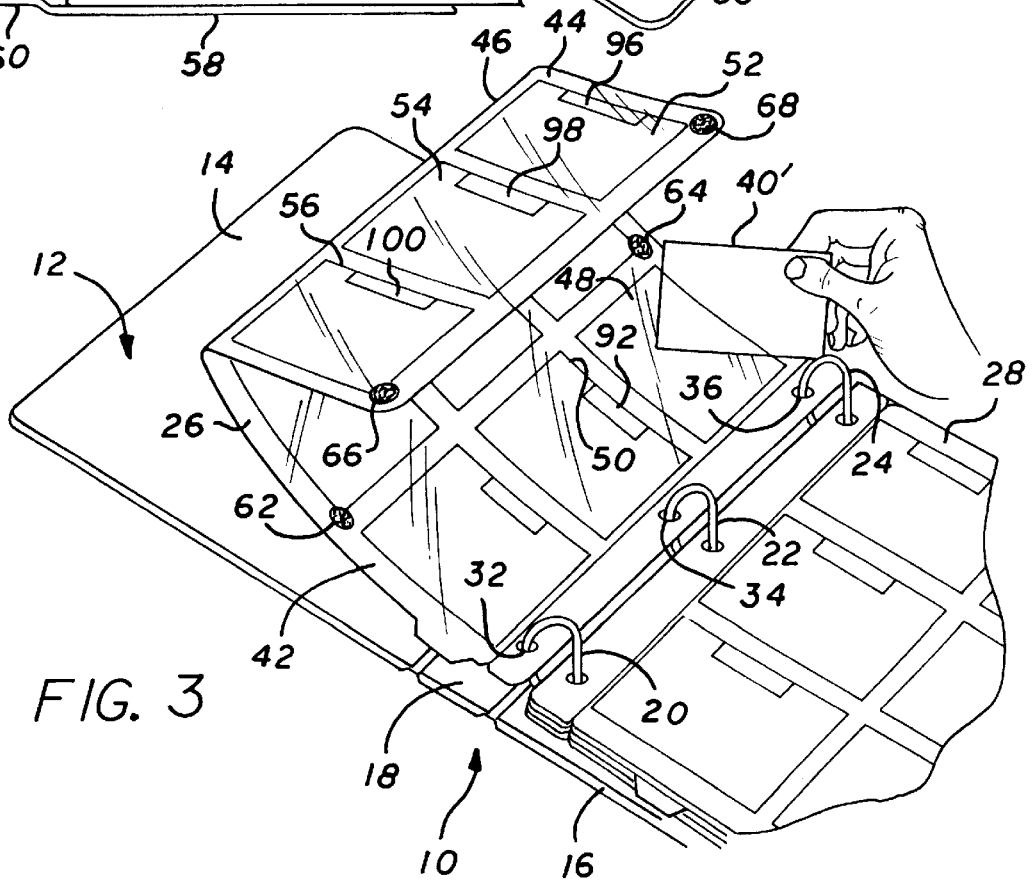
FIG. 3 is a perspective view of the lesson plan notebook of FIG. 1 and illustrating the manner by which a lesson plan card is inserted into a storage pocket of a lesson plan retaining sheet.

A lesson planner constructed in accordance with the preferred embodiment of the present invention is shown in FIGS. 1 and 3 and is identified generally by reference numeral 10. As shown in FIGS. 1 and 3, lesson planner 10 includes a foldable notebook 12 having a front cover 14 and an opposing rear cover 16. Front and rear covers 14 and 16 are each hinged to a central portion in the form of binder panel 18. Such elements 14, 16 and 18 may be constructed from cardboard covered by vinyl plastic, in a manner that is well known in the trade. If desired, notebook 12 may include a sealing flap 19 hinged along the outer edge of rear cover 16; when notebook 12 is closed, sealing flap can be extended over the outer edge of front cover 14 and secured thereto by a releasable fastening mechanism to keep the notebook closed until the user is ready to use it.

Three sets of split D-ring fasteners 20, 22 and 24 are secured to rear cover 16 proximate to binder panel 18. Also shown in FIGS. 1 and 3 are a number of lesson plan retaining sheets, including the two uppermost lesson plan retaining sheets 26 and 28. Lesson plan retaining sheet 26 includes an inner edge portion 30 that is three-hole punched, as indicated by apertures 32, 34, and 36. These apertures allow lesson plan retaining sheet 26 to be removably retained by split D-ring fasteners 20, 22, and 24, respectively. Split D-ring fasteners 32, 34 and 36 selectively open to permit lesson plan retaining sheet 26 to be added to, or removed from, foldable notebook 12, and selectively close to retain inserted lesson plan retaining sheets within foldable notebook 12. In this manner, foldable notebook 12 engages the inner edge portion of each of the lesson plan retaining sheets, including sheets 26 and 28.

Referring briefly to FIG. 4, storage box 38 is used to store a collection of lesson planning cards 40. These lesson plan cards are similar to index cards and are adapted to receive portions or components of lesson plans. After being completed by an instructor, each such card contains information used to assist the instructor in preparing and presenting a lesson plan for a class. As such cards are initially loose, an instructor may easily insert such cards into a typewriter and type a portion of a lesson onto each such card; alternatively, the instructor can handwrite notes onto such lesson plan cards, if desired. Storage box 38 might be used to store a whole semester's worth of lesson plans for one or several different classes. In this regard, lesson plan cards 40 may be color-coded, if desired, wherein each different color corresponds to a different subject or course. Each of such cards is preferably a uniform size, for example, three inches by five inches. As will become more apparent below, storage box 38 serves to store and organize lesson plan cards that are not currently inserted within one of the lesson plan retaining sheets contained by foldable notebook 12.

Referring again to FIGS. 1 and 3, each of the lesson plan retaining sheets, such as sheets 26 and 28, includes a first panel 42 and a second panel 44. First panel 42 includes inner edge portion 30 along one side thereof. The opposing side of first panel 42 is hingedly coupled to second panel 44 along a hinged fold joint 46 that extends generally parallel to inner edge portion 30. Hinged fold joint 46 allows second panel 44 to be folded generally behind and proximate to first panel 42 when lesson plan retaining sheet 26 is not in use. On the other hand, hinged fold joint 46 allows second panel 44 to be extended outwardly away from first panel 42 when lesson plan retaining sheet 26 is in use, as when an instructor is teaching a lesson to a class.

First and second panels 42 and 44 of lesson plan retaining sheet 26 each include a series of pockets for removably storing a lesson plan card. For example, first panel 42 includes storage pockets 48 and 50, while second panel 44 includes storage pockets 52, 54 and 56. Each of such pockets 48, 50, 52, 54 and 56 is of a uniform size commensurate with the uniform size of the lesson plan cards 40. Preferably, first panel 42 and second panel 44 are formed of clear thermoplastic for allowing any writing or printing appearing on an inserted lesson plan card to be visible therethrough. If desired, the instructor can even add notes to the back sides of such lesson plan cards, as the back sides of such lesson plan cards are visible through the rear face of lesson plan retaining sheet 26. In the preferred embodiment of the present invention, first panel 42 and second panel 44 are formed from the same sheet of thermoplastic, and hinged fold joint 46 is formed by well-known thermoplastic forming methods.

Figure 2:
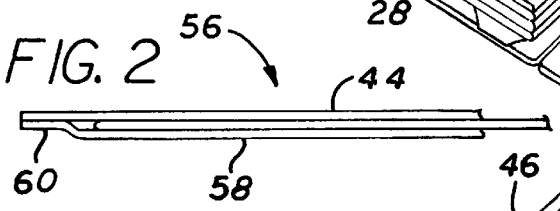
FIG. 2 is a cross-sectional view of one of the lesson plan card storage pockets shown in FIG. 1.

As shown in the cross-section of FIG. 2, pocket 56 is formed by securing a rectangular plastic sheet 58 along three edges (i.e., the two opposing side edges and the bottom edge) to the rear face of second panel 44, as by plastic welding methods, in order to form a pocket with an open upper edge. Within FIG. 2, one of such welded edges is indicated generally by reference numeral 60.

As indicated in FIG. 3, a lesson plan card 40' may be inserted, face down, into pocket 48 of first panel 42 from the rear side of first panel 42. When lesson plan retaining sheet 26 is then extended from notebook 12 in the position shown in FIG. 1, lesson plan card 40' is displayed through the clear plastic first panel 42. Likewise, lesson planning cards (not shown) inserted into the other pockets of first panel 42 (including pocket 50), and into the other pockets of second panel 44 (including pockets 52, 54 and 56), will be simultaneously displayed for reference by the instructor.

In order to maintain second panel 44 neatly within notebook 12 when lesson plan retaining sheet 26 is not in use, releasable fasteners are preferably included on each lesson plan retaining sheet. For example, with reference to FIGS. 1,3 and 5, lesson plan retaining sheet 26 includes releasable fasteners for temporarily retaining second panel folded against the rear face of first panel 42. In the preferred embodiment, such releasable fasteners consist of mating portions of hook-and-loop fabric of the type commercially available under the registered trademark "Velcro". Sections 62 and 64 of hooked fabric are secured to the rear face of first panel 42 adjacent the midpoints of the lower and upper edges thereof, respectively; sections 66 and 68 of complementary looped fabric are secured to the rear face of second panel 44 adjacent the lower and upper outer corners thereof, respectively. When the rear face of second panel 44 is folded back against the rear face of first panel 42, hooked fabric sections 62 and 64 come in contact with looped fabric sections 66 and 68 for fastening second panel 44 against first panel 42 until lesson plan retaining sheet 26 is again needed.

Referring now to FIG. 6, a series of lesson plan retaining sheets are identified by reference numerals 70, 72, 74 and 76. Each of sheets 70,72, 74 and 76 is provided with a tab 78, 80, 82 and 84 for receiving a label identifying the lesson plan displayed on the respective lesson plan retaining sheet. For example, as shown in the example of FIG. 6, tabs 78, 80, 80 and 82 bear labels indicating "Monday", "Tuesday", "Wednesday", "Thursday",etc., to indicate the day of the week to which each such lesson plan relates.

As has been mentioned above, it is also desirable to indicate a time of day during which each component of a lesson should be presented to assist the instructor in maintaining a desired rate of progress. To this end, and as shown in FIGS. 1 and 3, smaller label-holding pockets 90 and 92 may be provided just above lesson plan card storage pockets 48 and 50, respectively, on first panel 42 to provide a time of day during which the corresponding lesson plan components should be presented. Similar label-holding pockets 96, 98 and 100 are shown formed just above lesson plan card storage pockets 52, 54 and 56 on second panel 44. In FIG. 7, label 104 is shown being removed from label-holding pocket 90 disposed just above lesson plan card storage pocket 48; label 104 appears blank in the view of FIG. 7 as the indicia printed on label 104 faces downwardly in the view of FIG. 7. These labels could be broken down, for example, in fifteen minute intervals, starting at 7:45 a.m., and continuing through 4:30 p.m.

As mentioned above, the present invention also relates to a method of planning lessons to be taught to a class. In practicing the preferred embodiment of such improved method, one provides a notebook binder like foldable notebook 12. Lesson plan cards 40 are also provided to describe a variety of lessons to be taught; as mentioned above, such lesson plan cards are preferably of uniform size. A series of lesson plan retaining sheets, such as 26 and 28, are bound within notebook binder 12, and each of the lesson plan retaining sheets is provided with storage pockets, such as 48, 50, 52, 54 and 56, that are of a size commensurate with the uniform size of lesson plan cards 40 for removably storing one of such lesson plan cards 40. The instructor then selects a subset of lesson plan cards 40 corresponding to a particular lesson to be taught to a class on a given day and inserts the selected subset of lesson plan cards into the storage pockets 48, 50, 52, 54 and 56 of lesson plan retaining sheet 26 to display the selected lesson plan.

Such method can be expanded to plan and present two or more different lessons to be taught to a class on successive class meetings by selecting from lesson plan cards 40 two or more subsets of lesson plan cards corresponding to two or more different lessons, and then inserting the selected subsets of lesson plan cards into the storage pockets of a corresponding number of lesson plan retaining sheets 26, 28, etc., respectively, to display the selected lesson plans for such successive class meetings. For example, the lesson plan cards for Monday's class can be inserted into lesson plan retaining sheet 26, the lesson plan cards for Tuesday's class can be inserted into lesson plan retaining sheet 28, and so forth.

Similarly, the aforementioned method can be modified to plan and present two or more different lessons to be taught to different classes on a given day by selecting from the group of lesson plan cards 40 two or more subsets of lesson plan cards corresponding to two or more different lessons to be taught to two or more different classes on a given day. After selecting such subsets of lesson plan cards, the instructor inserts the selected subsets of lesson plan cards into the storage pockets of a corresponding number of lesson plan retaining sheets 26, 28, etc. to display each of the selected lesson plans for the different classes to be taught on such given day.

In its preferred embodiment, Applicant's method includes the step of forming lesson plan retaining sheets 26, 28 as including first and second panels 42 and 44, wherein first panel 42 is bound to the notebook binder, and second panel 44 is hingedly coupled to first panel 44 along a hinged joint 46. The step of providing lesson plan card storage pockets 48, 50, 52, 54 and 56 preferably includes the step of providing storage pockets 48 and 50 in first panel 42 and providing storage pockets 52, 54 and 56 in second panel 44. The step of inserting the selected subset of lesson plan cards 40 into the storage pockets of lesson plan retaining sheet 26 preferably includes the steps of inserting at least one lesson plan card 40' of the selected subset of lesson plan cards into a storage pocket (48, 50) of the first panel 42 and inserting at least one lesson plan card 40' into a storage pocket (52, 54, 56) of the second panel 44 of lesson plan retaining sheet 26. Such preferred embodiment of Applicant's method further includes the steps of folding second panel 44 along the hinged fold joint 46 to lie against and proximate to first panel 42 when lesson plan retaining sheet 26 is not in use, and extending second panel 44 away from first panel 42 when lesson plan retaining sheet 26 is in use. Ideally, such method includes the step of releasably fastening second panel 44 to first panel 42, as by mating hook-and-loop fasteners 62, 64, 66 and 68, for example, when lesson plan retaining sheet 26 is not in use.

The preferred embodiment of Applicant's method also makes use of the label holder feature already described above. In this regard, such method may include the steps of applying a label, such as label 104 (see FIG. 7) adjacent to each storage pocket 48 indicating a time of day, class period, or other indicia representing a time at which such lesson plan component should be taught. The instructor then inserts the selected subset of lesson plan cards 40' into the storage pockets 48, 50, 52, 54 and 56 of lesson plan retaining sheet 26 in accordance with the time of day and/or class period during which each component of the lesson is to be taught; in this manner, each of the lesson plan cards in the selected subset of lesson plan cards is displayed in a storage pocket proximate to a corresponding label indicating the time of day during which such component is to be taught.

Those skilled in the art will now appreciate that an improved apparatus and method have been described for planning and presenting lessons to a class. Once the lessons are recorded on the lesson plan cards for a first academic year, creation of one week's worth of lesson plans can be achieved relatively easily simply by selecting the desired lesson plan cards from the storage box and inserting them into the notebook. At the end of the week, those lesson plan cards which have already been covered are returned to the storage box, and the following week's lesson plan cards are removed from the storage box and inserted into the notebook. The lesson plan cards can be much larger than the rather small spaces provided in conventional lesson planning books, so the printed material applied to such cards is easier to read. Also, because such lesson plan cards are initially loose, lesson plans can easily be typed onto such lesson plan cards, thereby avoiding the need for the teacher to handwrite each lesson plan, and making such lesson plans easier to read. Yet, the notebook and collapsed (i.e., folded-over) lesson plan retaining sheets are compact enough for convenient transport. In addition, if one lesson proceeds more quickly or more slowly than originally anticipated, it is a simple matter to shift the lesson plan cards (or the time of day labels) to adjust for the change in scheduling. Moreover, a lesson plan retaining sheet can easily be removed from the notebook and inserted into a photocopy machine, if desired; by using the size reduction feature provided on most photocopiers, an instructor can thereby quickly make an 8½ inch by 11 inch copy of that day's lesson plan. Further, because the day and/or time of day labels are part of the lesson plan retaining sheets, an instructor need not handwrite such information for each lesson plan.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A lesson planner comprising in combination:

a. a foldable notebook having front and rear covers, said foldable notebook including a central portion coupling said front and rear covers to each other;

b. a plurality of lesson plan retaining sheets, each of said lesson plan retaining sheets including an inner edge portion;

c. fasteners secured proximate to said central portion of said notebook for engaging the inner edge portion of each of said plurality of lesson plan retaining sheets;

d. a plurality of lesson plan cards containing information used to assist an instructor in preparing and presenting a lesson plan for a class, each of said lesson plan cards being of a predetermined size;

e. each of said plurality of lesson plan retaining sheets including at least first and second panels, the first panel being coupled with the inner edge portion of said lesson plan retaining sheet, and the second panel being hingedly coupled to the first panel along a hinged coupling that extends generally parallel to the inner edge portion of said lesson plan retaining sheet, the hinged coupling permitting the second panel to be folded proximate to the first panel when said lesson plan retaining sheet is not in use, and to be extended outwardly away from the first panel when said lesson plan retaining sheet is in use, the second panel having an outer edge opposite the hinged coupling and the second panel having a width extending between the hinged coupling and the outer edge of the second panel the width of the second panel being of a dimension that maintains the outer edge of the second panel spaced apart from the inner edge portion of said lesson plan retaining sheet even when the second panel is folded proximate to the first panel, the first and second panels of each lesson plan retaining sheet including a plurality of pockets for removably storing one of said plurality of lesson plan cards, each of said pockets being of a size commensurate with the predetermined size of said lesson plan cards, each lesson plan retaining sheet displaying the lesson plan cards stored in the pockets of the first and second panels thereof when the second panel is extended outwardly away from the first panel.

2. The lesson planner recited by claim 1 wherein each of said lesson plan retaining sheets is formed of clear plastic.

3. A lesson planner comprising in combination:

a. a foldable notebook having front and rear covers, said foldable notebook including a central portion coupling said front and rear covers to each other;

b. a plurality of lesson plan retaining sheets, each of said lesson plan retaining sheets including an inner edge portion;

c. fasteners secured proximate to said central portion of said notebook for engaging the inner edge portion of each of said plurality of lesson plan retaining sheets;

d. a plurality of lesson plan cards containing information used to assist an instructor in preparing and presenting a lesson plan for a class, each of said lesson plan cards being of a predetermined size;

e. each of said plurality of lesson plan retaining sheets including at least first and second panels, the first panel being coupled with the inner edge portion of said lesson plan retaining sheet, and the second panel being hingedly coupled to the first panel along a hinged coupling that extends generally parallel to the inner edge portion of said lesson plan retaining sheet, the hinged coupling permitting the second panel to be folded proximate to the first panel when said lesson plan retaining sheet is not in use, and to be extended outwardly away from the first panel when said lesson plan retaining sheet is in use, the first and second panels of each lesson plan retaining sheet including a plurality of pockets for removably storing one of said plurality of lesson plan cards, each of said pockets being of a size commensurate with the predetermined size of said lesson plan cards, each lesson plan retaining sheet displaying the lesson plan cards stored in the pockets of the first and second panels thereof when the second panel is extended outwardly away from the first panel, and wherein each said lesson plan retaining sheet further includes a releasable fastener for temporarily retaining the second panel proximate the first panel when said lesson plan retaining sheet is not in use.

4. The lesson planner recited by claim 3 wherein said releasable fastener included on each of said lesson plan retaining sheets includes a section of hooked fabric secured to one of said first and second panels and a section of complementary looped fabric secured to the other of said first and second panels, and wherein folding of the second panel proximate the first panel brings section of hooked fabric in contact with the section of looped fabric.

5. The lesson planner recited by claim 1 wherein the central portion of said foldable notebook is a central panel hingedly connecting the front and rear covers thereof.

6. The lesson planner recited by claim 1 wherein said fasteners selectively open to permit a lesson plan retaining sheet to be added to or removed from said foldable notebook, and selectively close to retain said lesson plan retaining sheets within said foldable notebook.

7. The lesson planner recited by claim 6 wherein said fasteners are split rings.

8. The lesson planner recited by claim 1 further including a storage box for storing lesson plan cards that are not inserted within a pocket of one of said lesson plan retaining sheets.

9. The lesson planner recited by claim 8 wherein said lesson plan cards are color-coded corresponding to the subject being taught.

10. The lesson planner recited by claim 1 wherein each of said plurality of lesson plan retaining sheets includes a plurality of label holders, each of said plurality of label holders being disposed proximate one of said lesson plan card storage pockets for displaying a label corresponding to a time of day during which a lesson contained on a corresponding lesson plan card is to be taught to a class.

11. A method of planning lessons to be taught to a class, said method comprising the steps of:

a. providing a notebook binder;

b. providing a plurality of lesson plan cards describing a plurality of lessons to be taught to the class, each of the lesson plan cards being of a predetermined size;

c. binding a plurality of lesson plan retaining sheets within the notebook binder, each of the lesson plan retaining sheets including first and second panels, the first panel being bound to the notebook binder, and the second panel being hingedly coupled to the first panel along a hinged coupling, and wherein each of the first and second panels has a plurality of storage pockets for removably storing one of the lesson plan cards, each of the pockets being of a size commensurate with the predetermined size of the lesson plan cards;

d. selecting from the plurality of lesson plan cards a subset of lesson plan cards corresponding to a particular lesson to be taught to a class on a given day;

e. inserting at least one lesson plan card of the selected subset of lesson plan cards into the storage pockets of each of the first and second panels of at least one lesson plan retaining sheet;

f. folding the second panel of a lesson plan retaining sheet along the hinged coupling proximate to the first panel thereof when such lesson plan retaining sheet is not in use; and g. extending the second panel of such lesson plan retaining sheet away from the first panel thereof when such lesson plan retaining sheet is in use to display the selected lesson plan.

12. The method recited by claim 11 including the steps of selecting from the plurality of lesson plan cards a plurality of subsets of lesson plan cards corresponding to a plurality of different lessons to be taught to different classes on a given day; and inserting the selected plurality of subsets of lesson plan cards into the storage pockets of a corresponding plurality of lesson plan retaining sheets to display the plurality of selected lesson plans for the different classes to be taught on such given day.

13. The method recited by claim 11 including the steps of selecting from the plurality of lesson plan cards a plurality of subsets of lesson plan cards corresponding to a plurality of different lessons to be taught to a class on successive class meetings; and inserting the selected plurality of subsets of lesson plan cards into the storage pockets of a corresponding plurality of lesson plan retaining sheets to display the plurality of selected lesson plans for such successive class meetings.

14. The method recited by claim 11 including the steps of:

a. applying a label proximate each storage pocket indicating a time of day;

b. selecting from the plurality of lesson plan cards a subset of lesson plan cards which collectively set forth a lesson to be taught to a class on a given day, each of the lesson plan cards within such selected subset of lesson plan cards including a component of the lesson to be taught to the class on such day; and c. inserting the selected subset of lesson plan cards into the storage pockets of a corresponding lesson plan retaining sheet in accordance with the time of day during which each component of the lesson is to be taught in order to display each of the lesson plan cards in the selected subset of lesson plan cards proximate to the label indicating the time of day during which such component is to be taught.

15. A method of planning lessons to be taught to a class, said method comprising the steps of:

a. providing a notebook binder;

b. providing a plurality of lesson plan cards describing a plurality of lessons to be taught to the class, each of the lesson plan cards being of a predetermined size;

c. binding a plurality of lesson plan retaining sheets within the notebook binder, each of the lesson plan retaining sheets including at least first and second panels, the first panel being bound to the notebook binder, and the second panel being hingedly coupled to the first panel along a hinged coupling, and wherein each of the first and second panels has at least one storage pocket formed therein for removably storing one of the plurality of lesson plan cards, each of said storage pockets being of a size commensurate with the predetermined size of said lesson plan cards, and d. selecting from the plurality of lesson plan cards a subset of lesson plan cards corresponding to a particular lesson to be taught to a class on a given day;

e. inserting the selected subset of lesson plan cards into the storage pockets of the first and second panels of at least one lesson plan retaining sheet to display the selected lesson plan; and f. releasably fastening the second panel of the at least one lesson plan retaining sheet to the first panel thereof when such lesson plan retaining sheet is not in use.

* * * * *